US005772202A

United States Patent [19]

Singer et al.

[11] Patent Number: 5,772,202

[45] Date of Patent: Jun. 30, 1998

[54] METHOD AND APPARATUS FOR REGISTERING SHEETS

[75] Inventors: Karl Singer, Barrington Hills; Lawrence B. LeStarge, Elgin; Robert Allen Crimmins, Algonquin, all of Ill.

[73] Assignee: D&K Custom Machine Design, Inc., Elk Grove Village, Ill.

[21] Appl. No.: 719,730

[22] Filed: Sep. 25, 1996

[51] Int. Cl.[6] ..... B65H 9/04

[52] U.S. Cl. ..... 271/246; 271/245; 271/273; 271/275; 271/277

[58] Field of Search ..... 271/243, 244, 271/245, 246, 273, 275, 277

[56] References Cited

U.S. PATENT DOCUMENTS

| | | | |
|---|---|---|---|
| 2,410,611 | 11/1946 | Pratt et al. | 271/275 |
| 4,171,129 | 10/1979 | Daley et al. | 271/245 |
| 4,360,196 | 11/1982 | Weisbach | 271/245 |
| 5,094,443 | 3/1992 | Young | 271/245 |

FOREIGN PATENT DOCUMENTS

| | | | |
|---|---|---|---|
| 1 014 416 | 8/1952 | France | 271/245 |

*Primary Examiner*—H. Grant Skaggs
*Attorney, Agent, or Firm*—Wallenstein & Wagner, Ltd.

[57] ABSTRACT

A registration/indexing system is disclosed having a conveyor system (20), a gate (30), a plurality of hard rollers (40,50) and a plurality of soft rollers (60).

22 Claims, 5 Drawing Sheets

METHOD AND APPARATUS FOR REGISTERING SHEETS

DESCRIPTION

1. Technical Field

The present invention relates generally to laminating machines and, more particularly, to a novel registration/indexing assembly and method assuring the alignment of sheets entering the laminating portion of the system.

2. Background Prior Art

Today, there are numerous uses and applications of laminated products. Such products typically include a sheet of paper disposed between two sheets of film. Examples of such products include menus, book covers, presentation folders, boxes, video cassette cases, record and CD jackets and displays for stores. Prior to lamination, the sheets to be laminated are often precut and stacked. Once stacked, the sheets are individually fed by a sheet feeder to a lamination unit. This process involves two important aspects. The first is the actual feeding mechanism which lifts and physically moves the individual sheets to the laminator. This aspect of the system is required to work at high speeds with both great accuracy and consistency. The second aspect is the registration and indexing system. Prior to entering the laminating portion of the machine, it is important to ensure the sheets are properly aligned to the laminator. Improper alignment results in damage and/or inconsistencies in the final product, not to mention down-time to realign or repair the system. In an effort to continuously improve upon the laminating process and machines available in the marketplace, the following advancements and improvements were developed to the indexing and registration portion of the laminating machine.

SUMMARY OF THE INVENTION

According to a first aspect of the present invention, a registration system for a sheet feeder is disclosed having feeder means for continuously and longitudinally feeding a plurality of sheets sequentially from an upstream position to a downstream position. The system further includes a retractable gate movable between an engaging position and a nonengaging position. In the nonengaging position, the gate does not affect the longitudinal movement of a sheet being fed by the feeder means and in the engaging position, the gate contacts a leading edge of a sheet to stop the longitudinal movement of the sheet being fed by the feeder means. There are further a plurality of two transversely spaced apart first or "soft" rollers upstream of the gate that are moveable between an engaging position and a nonengaging position. In the nonengaging position, the first/soft rollers do not affect the longitudinal movement of a sheet and in the engaging position, the first/soft rollers contact and put weight and pressure upon a sheet being fed by the feeder means while simultaneously the first/soft rollers permit slippage between the sheet and the first/soft rollers. There are, additionally, a plurality of transversely spaced apart second or "hard" rollers upstream of the gate also moveable between an engaging position and a nonengaging position. Like the first, soft rollers, in the nonengaging position, these second/hard rollers do affect the longitudinal movement of a sheet. However, in the engaging position, these second/hard rollers frictionally engaging a sheet being fed by the feeder means. Slippage between the hard rollers and a sheet passing thereunder is undesired and minimized. The pressure exerted on the travelling sheets by the hard rollers is greater than the pressure exerted by the soft rollers. Finally, control means are provided for engaging, nonengaging and coordinating the first and second rollers and the gate to the following repeatable cycle:

i) while the gate is disengaged, the first rollers are disengaged and the second rollers are engaged, simultaneously the feeder means in combination with the second rollers are moving a first and a second sheet downstream;

ii) while the gate is engaged, and the first and second rollers are disengaged, simultaneously the feeder means is moving a second sheet downstream and a third sheet downstream to the first rollers;

iii) while the gate is engaged, the first rollers are engaged and the second rollers are disengaged, simultaneously the feeder means is moving the second sheet further downstream and in combination with the first rollers moving the third sheet until the third sheet is aligned with the gate; and, iv) while the gate is engaged, and the first and second rollers are disengaged, simultaneously the feeder means is moving the second sheet downstream until a predetermined overlap between the second and third sheets is obtained.

In short, when the gate is up and engaged, the first/soft rollers engage the sheet and when the gate is down (disengaged), the second/hard rollers engage the sheet.

In the embodiment shown, the feeder means is a conveyer in communication with the first and second rollers when the roller is in the engaging position. This conveyor incorporates a plurality of parallel, high friction conveyor belts entrained around two shafts. Each shaft has couplers thereon disposed between the belts with low friction, smooth outer surfaces.

In this manner, a predetermined overlap can be obtained between the travelling sheets and perfect registration of each sheet can be obtained. Thus, when the gate is in the engaging position (up and blocking a leading edge (LE) of the sheet from passing therethrough or thereover), the first/soft rollers will permit slipping, or slippage, between the sheet and the soft rollers. If a sheet is being moved by the conveyor belts in a non-perpendicular manner (i.e., the leading edge of the sheet makes an acute angle with the gate) to the gate, the soft rollers will engage, descend and contact the sheet. A portion of the sheet's leading edge (usually a corner) will contact the gate and stop the sheet from passing beyond the gate. The portion of the sheet trailing that portion which contacted the gate will continue to be driven (or rotated into position) by the conveyor belts with the assistance of the first/soft rollers until the entire leading edge of the sheet is contacting or flush with the gate. The soft rollers contacting that portion of the sheet rotating into position merely rotate or slip permitting that portion of the sheet to continue to move/rotate. Because the soft rollers are not driving rollers, they do not drive the sheet into or beyond the gate. Rather, they permit the conveyor belts to drive the sheet into the gate and the sheet to stay at the gate without bunching or backing up at the gate.

A plurality of continuous pulling hard rollers, like the second/hard rollers above, but always in the engaging position, are further located downstream of the gate and the first and second rollers. These pulling hard rollers are for pulling the sheets being fed by the feeder means.

All the rollers are each attached to a control member by a cantilevered arm and each control member is supported on a transverse support rod and is adapted to be moveable relative to the support rod and selectively locked into a position on the support rod to selectively control the transverse distance between each control member.

Other advantages and aspects of the present invention will become apparent upon reading the following description of the drawings and the detailed description of the invention.

BRIEF DESCRIPTION OF DRAWINGS

To understand the present inventions, it will now be described by way of example, with reference to the accompanying drawings in which.

DETAILED DESCRIPTION

Figure 1:
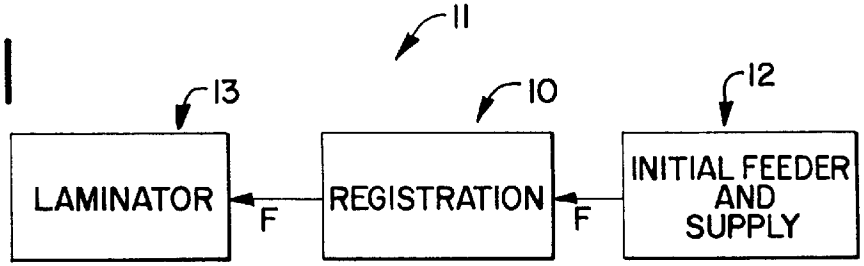
FIG. 1 is a block diagram of the overall system.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to embodiment illustrated.

Figure 2:
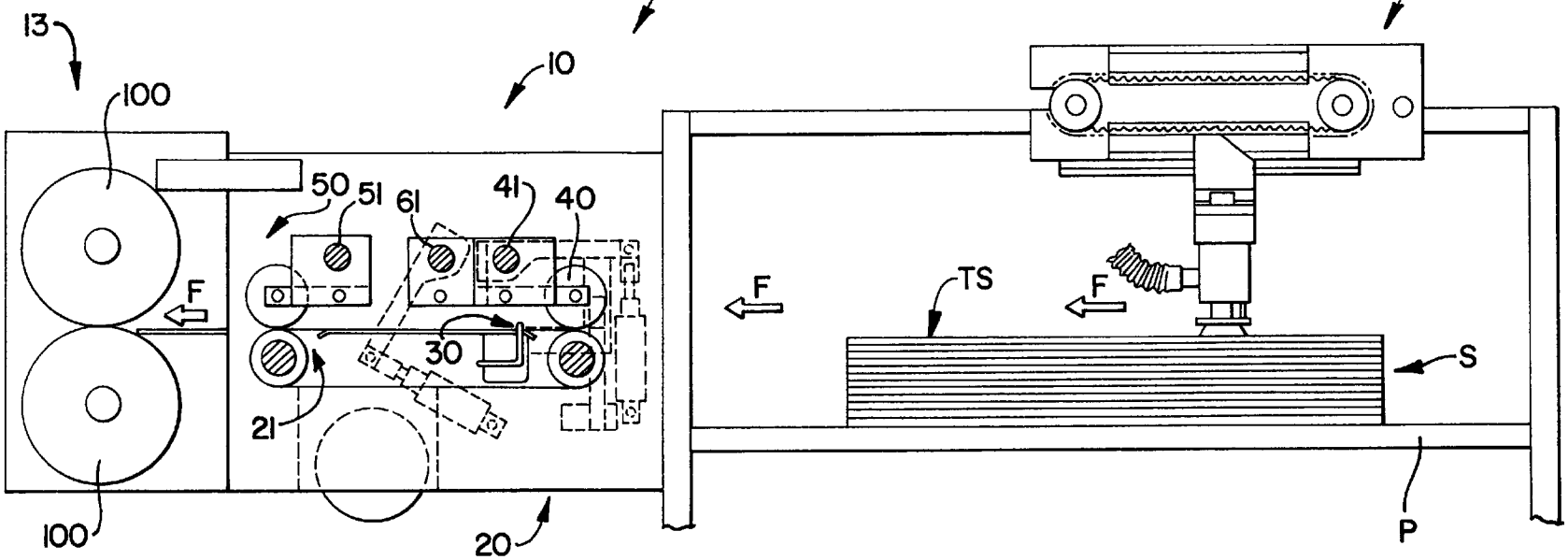
FIG. 2 is a side elevation view of the initial feeder section and the registration section of the present invention.

As shown generally in FIG. 1 and in more detail in FIG. 2, the feeder system or feeder assembly 10 is the part of the laminating machinery 11 disposed between the feeder box 12 (initial feeder) and the nip rollers 100 for the laminator 13. At the input side of a laminating machine, there is either a plurality of sheets (S) stacked or a supply roller of a continuous sheet. The sheet(s) of material(s) are laminated by the laminating machine on either one side or both sides by a plastic film. Details of commercially successful laminating machines can be found in U.S. Pat. Nos. 4,329,896; 4,470,589; 4,517,042; 4,743,334; 5,019,203; 5,071,504; 5,079,981 and 5,139,600 manufactured and owned by Assignee of the present invention, D&K Custom Machine Design, Inc. (Elk Grove Village, Ill.), incorporated herein by reference.

Individual sheets are typically fed into the feeder assembly by a sheet feeder, such as the ones described in U.S. Pat. Nos. 4,470,589; 5,183,242 and U.S. Ser. No. 08/718,923, filed the same day as this application, Sep. 25, 1996, and titled METHOD AND APPARATUS FOR FEEDING SHEETS, also manufactured and owned by the Assignee of the present invention, D&K Custom Machine Design, Inc., and incorporated herein by reference.

The registration and alignment system 10 of the present invention is disposed between this laminating portion 13 of the machine and this initial feeder portion 12 of the machine 11 to ensure the sheets sequentially fed by the initial feeder are squared, or properly positioned, before entering the laminating portion of the machine, and do not "bunch up," that is, stack and wrinkle undesirably upon one another. The system ensures alignment and proper overlap of the sheets to the laminating portion of the machine.

Specifically, as individual sheets are fed into the registration portion of the present machine, they are in contact with a conveyer portion 20 of the machine that feeds each sheet (top sheet—TS) to the laminator portion. Sheets are oftentimes fed with the leading edge (LE) being angular to the longitudinal axis or flow (F) (see FIG. 7) when they should be perpendicular to the flow. In short, a properly fed sheet has the leading edge parallel with the laminator 100. The leading edge should not form an acute angle with the laminating/nip rollers 100. (See FIG. 7).

The primary components of this registration system are a conveyor system 20, a gate 30, a plurality of "hard" rollers 40,50 and a plurality of "soft" rollers 60.

Figure 3:
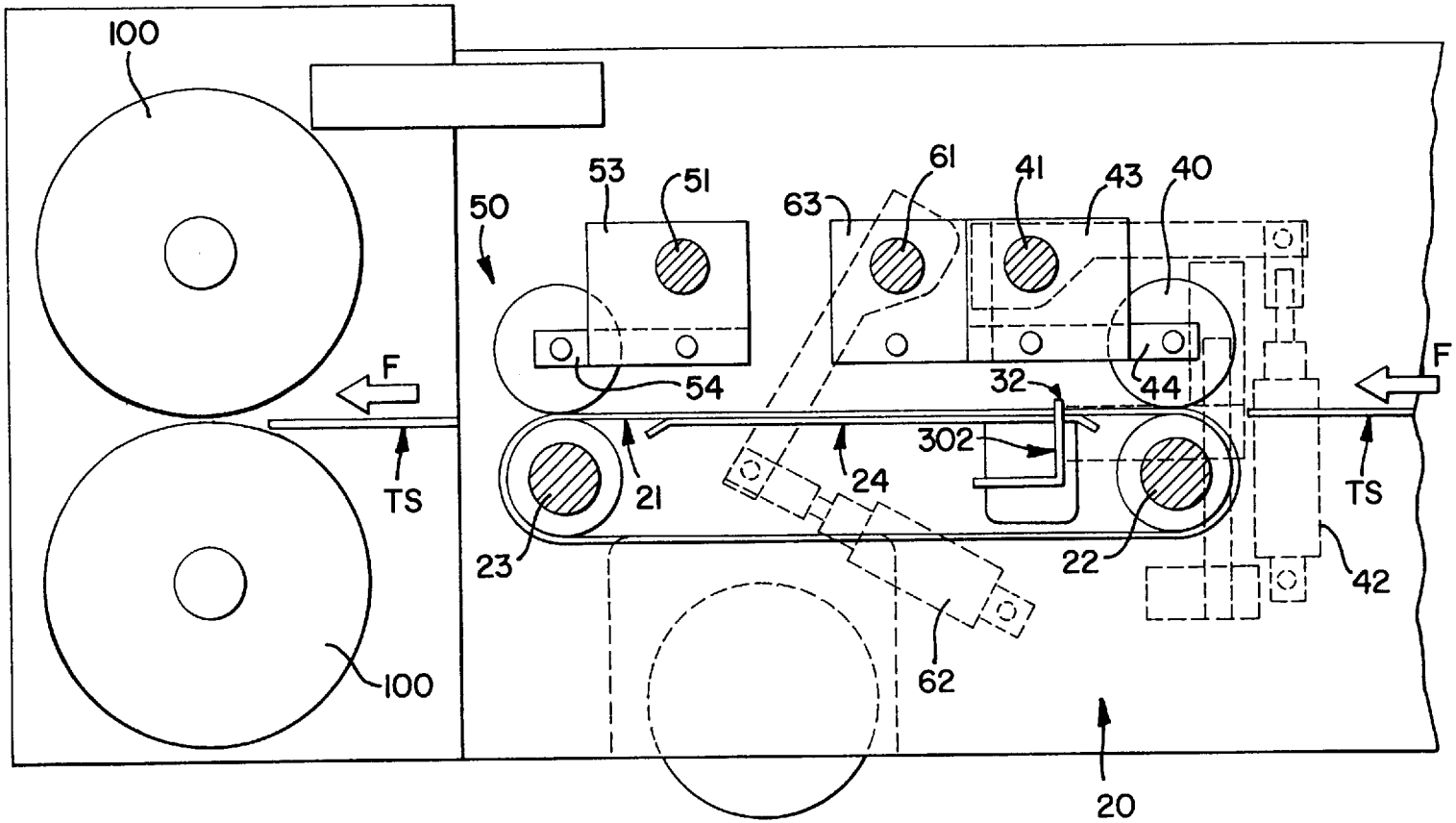
FIG. 3 is a side elevation view of the registration and indexing section.

The conveyer system includes a plurality of parallel belts 21. Each belt is composed of a material having a high coefficient of friction, e.g., rubber, and is entrained around opposed shafts 22,23. As shown in FIG. 3, for the conveyor section there is a shaft at one end 23 (driven by a motor (M)) and a shaft at the other end 22 (an idler, driven by the belts) with a table or platform 24 disposed therebetween. Both shafts 22,23 support the belts 21, with the one shaft 23 driving the belts along with the other shaft 22. The belts, in turn, support the sheets (TS) and abut and ride on top of the table 24. The table 24 is disposed between the shafts.

Figure 5:
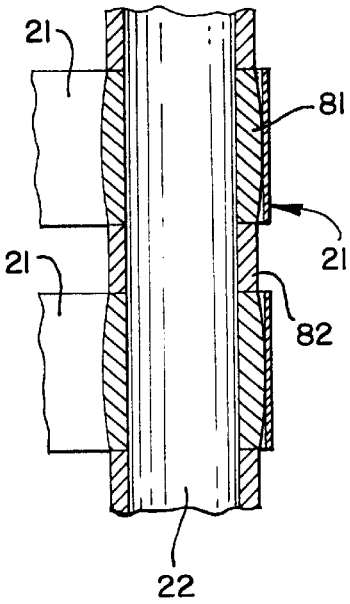
FIG. 5 is a sectional view of the shafts and couplers used in the registration section.

In actual construction, the shafts 22,23 support a plurality of couplers 81,82 thereon. A detail of this construction is shown in FIG. 5. There are alternating first 22 and second 23 couplers around the shaft. The first couplers 81 abut and support the belts 21 and the second couplers 82 are disposed between the first couplers 81 and the belts 21. The first couplers 81 are crowned, or arcuate, while the second couplers 82 are flat and smooth. Specifically, the second couplers are preferably smoothed, polished metal for preventing any sheets from unintentionally collecting or getting caught thereon.

In the preferred embodiment, the conveyer section 20 is hingably connected to the machine. This hinged connection permits the conveyor section (table, shaft and belts) to be pivoted, or opened, for easy repair and cleaning. In addition, the conveyor belts 21 are continuously running; the belts are continuously moving downstream. This avoids switching them on and off continuously.

There are three (3) transverse rods 41,51,61 above the conveyor section 20. These rods support a first set of hard rollers 40, a set of soft rollers 60 and a second set of hard (pull) rollers 50.

The gate 30, positioned between the first (upstream) shaft 22 and the second (downstream) shaft 23 at the downstream portion of the conveyor section, is constructed within the table 24 so that sections (projecting portions 32 (FIG. 3)) thereof project above the top surface of the table 24 between the belts 21. This gate acts as a controlled stop or bumper. The gate is retractable by conventional means resulting in the projecting portions being lowered below the top of the table and conveyor belts. Consequently, the gate 30 moves between an engaging position and a disengaging position. In the disengaging position, the projecting portions 32 of the gate 30 are situated below the planes of the sheets (TS), belts 21 and table 24. As a result, the gate does not affect the longitudinal movement (F) of the sheets on the table and belts. In the engaging position, the projecting portions of the gate extend above the planes of the sheets, belts and table. Thus, when engaged, the gate acts as a bumper or stop, contacting a leading edge (LE) of a sheet and thus stopping the longitudinal movement downstream of any sheets it contacts on the table and belts.

The soft rollers 60 are transversely spaced apart rollers located upstream of the gate 30 and positioned above the conveyor belts 21 and table 24. In practice, they are positioned to contact the belts or the sheets thereon abutting the first, upstream shaft 22. These soft rollers 60 are rigid with a rubber belt (not shown) therearound. Each soft roller 60 is moveable between an engaging position and a disengaging position. In the disengaging position, the first or soft rollers 60 are positioned away from the conveyor section or completely above the conveyor belts and sheets thereon. As a result, in the disengaged position, these soft rollers do not affect the longitudinal movement (F) of a sheet being moved by the conveyor belts or a stationary sheet stopped by a gate. Contrarily, in the engaging position, the soft rollers 60 come down and contact the sheets being fed by the conveyor belts. The mechanics 62 (hydraulics or pneumatics) for moving the soft rollers 60 are conventional and are shown in schematic and phantom lines in FIG. 3.

These soft rollers 60 are not driven by an outside source, such as a motor. They are idlers or riders. One may consider them rotating weights or constant pressure points. As a result, when the soft rollers are engaged, they are brought in contact with the sheet disposed on the belts between the soft rollers and the shaft or second couplers. In this manner, the soft rollers bear down and place a small amount of pressure on the sheet.

Figure 7:
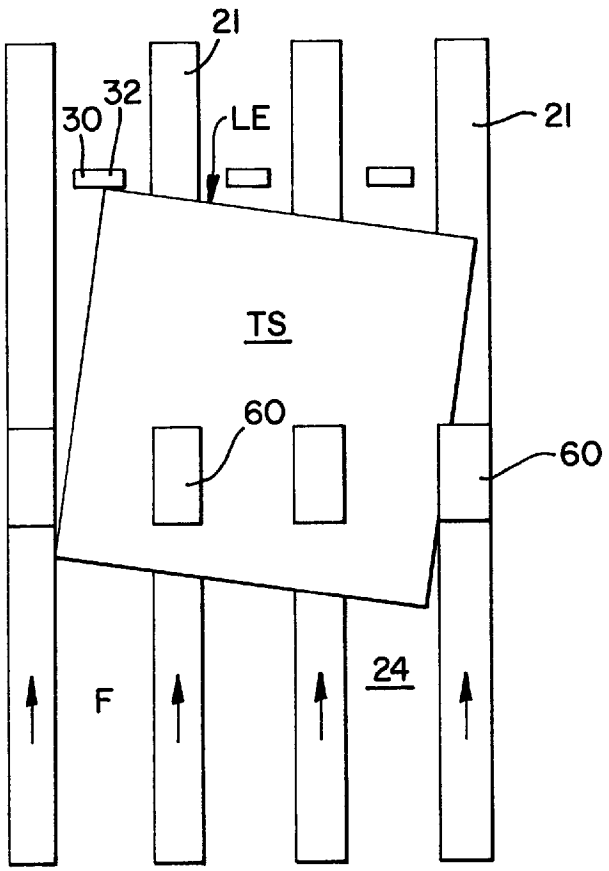
FIG. 7 is a schematic diagram of a top sheet at the gate.
Figure 7:
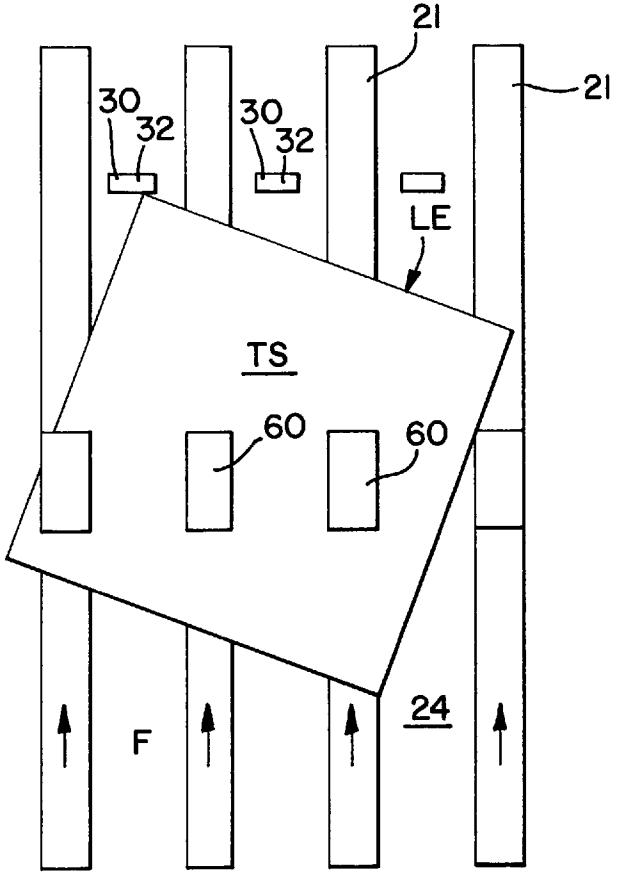

However, as shown graphically in FIG. 7, when the gate 30 is up and blocking a leading edge (LE) of the sheet from passing therethrough or thereover, the soft rollers will permit slipping, or slippage, between the sheet and the soft rollers. Specifically, if a sheet (TS) is being moved by the conveyor belts in a non-perpendicular manner (i.e., the leading edge of the sheet makes an acute angle with the gate) to the gate, the soft rollers will engage, descend and contact the sheet. A portion of the sheet's leading edge (usually a corner) will contact one or more projecting portions of the gate and stop the sheet from passing beyond the gate. The portion of the sheet trailing that portion which contacted the gate will continue to be driven (or rotated into position) by the conveyor belts with the assistance of the soft rollers until the entire leading edge of the sheet is contacting or flush with the gate. The soft rollers contacting that portion of the sheet rotating into position merely rotate or slip permitting that portion of the sheets to continue to move/rotate. Because the soft rollers are not driving rollers, they do not drive the sheet into or beyond the gate. Rather, they permit the belts 21 to drive the sheet into the gate and the sheet to stay at the gate without bunching or backing up at the gate 30.

The hard rollers 40 are also transversely spaced apart rollers located upstream of the gate 30. This first set of hard rollers 40 is positioned above and adjacent the first, upstream shaft 22 above the belts 21 and table 24. As with the soft rollers, the hard rollers 40 are positioned so as to contact the belts 21 at the point where the belts contact the shaft 22. These hard rollers, like the soft rollers, are not driving rollers, they are driven by the belts and rotate with the belts and shaft. In addition, these hard rollers are positioned adjacent the soft rollers. In practice, they are positioned to contact a first coupler 81 (supporting a belt) on a shaft 22 of the conveyor section 20. These hard rollers 40, like the soft rollers, are rigid with a rubber belt therearound. In the preferred embodiment, their outer surfaces are capable of frictionally engaging the sheets passing therebelow. Each hard roller is moveable between an engaging position and a disengaging position. In the disengaging position the second or hard rollers are positioned away from the conveyor section or completely above the conveyor belts and sheets (LE) thereon. As a result, in the disengaged position, these hard rollers do not affect the longitudinal movement (F) of a sheet being moved by the conveyor belts or a stationary sheet stopped by a gate 30. Contrarily, in the engaging position, the hard rollers come down and contact the sheets being fed by the conveyor belts. The mechanics 42 (hydraulics or pneumatics) for moving the hard rollers 40 are shown in schematic and phantom lines in FIG. 3.

A second set of hard rollers 50 (for clarity called pull rollers) are positioned downstream of the gate 30 and the first, soft rollers 60 and the second hard rollers 40. These pull rollers 50 are constructed like the hard and soft rollers above and are always engaged.

As to the mechanics of the rollers, each of the hard and the soft rollers 40,60 and the pull rollers 50, are supported by a control housing/member 43,53,63. Specifically, the feeder section includes three parallel, transverse rods 41,51,61 (generally keyed). In a direction from feed to the laminator, the first rod 41 supports the hard rollers 40, the second rod 61 supports the soft rollers 60 and the third rod 51 supports the pull rollers 50. In particular, the control housings 43,53, 63 each have a transverse aperture therein (also keyed for the rod) for receiving its respective rod 41,51,61. A thumb screw or other conventional fastener (not shown) passing through the housing engages the rod passing within the housing 43,53,63 and locks the housing into the position on the rod 41,51,61. This also allows one to move the housings and rollers in the transverse direction to accommodate sheets of different widths. A cantilevered arm 44,54,64 projects from the housing 43,53,63 and supports the roller 40,50,60 at the distal end thereof. Upon a signal or command, a mechanism (not shown) within the control member lifts the arm and roller away from the conveyor belts, shaft and table top to the disengaged position. Similarly, upon another similar signal or command, the mechanism (not shown) within the control member drops or lowers the arm and roller toward the conveyor to the engaged position.

Figure 4:
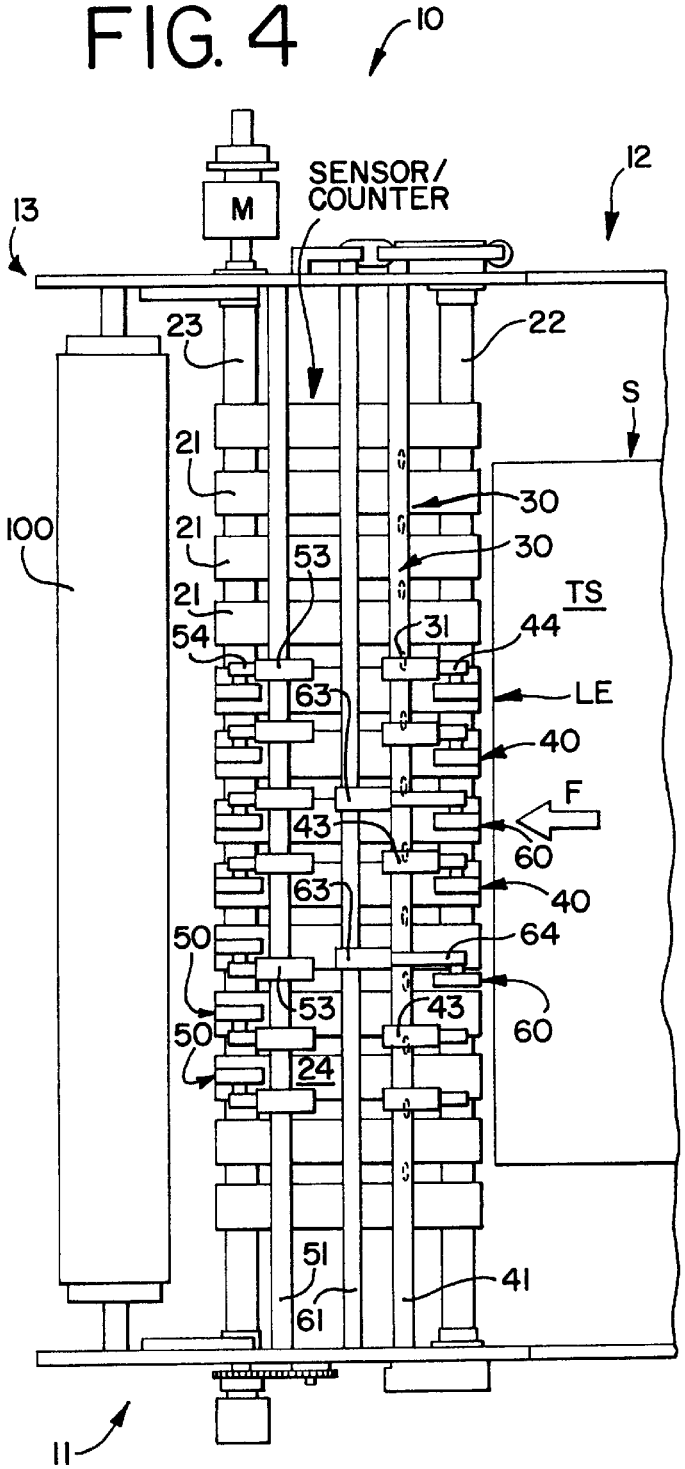
FIG. 4 is a top plan view of the registration section.

As shown in FIG. 4, the arms 64 for the soft rollers 60 are longer than the arms 44 for the hard rollers 40. Thus, with these longer arms, the soft rollers can be positioned parallel to the hard rollers.

The above construction allows a user to move the control housings, and hence the rollers, to any desired location along the support rod. Being moveable relative to the support rod and selectively locked into a position on the support rod, permits a user to selectively control the transverse distance between each control member. Thus, the entire machine can be easily adapted for sheets with different transverse widths.

The hard rollers and soft rollers differ in two respects. First, the hard rollers are urged against the shaft/belt and sheets harder than the soft rollers. When in the engaged position, the hard rollers act like a pressure nip. As a result, there is little, if any, slip between the hard rollers and the belts. Ideally, there is no slip between the hard rollers and the belts, or sheets disposed therebetween. Together, the hard rollers and belts drive the sheet disposed therebetween when the hard rollers are engaged. In this manner, the sheet is driven, assuring the progression of the sheets downstream.

Contrarily, the soft rollers exert little pressure on the belts and sheets disposed therebetween. As noted previously, the pressure between the soft rollers and the belts permits the sheets therebetween to slip if necessary. In short, the soft rollers exert less pressure on the travelling sheets than the hard rollers.

Second, as just noted, the arms supporting the hard and soft rollers are different lengths. Thus, the shorter arms of the hard rollers ensures the pressure is maintained between the hard rollers and the belts.

With the above construction, when the gate is up and blocking the leading edge of the sheet from passing therethrough or thereover, the soft rollers will drive the sheet to the gate. When the gate is down and not blocking the leading edge of the sheet, the hard rollers drive the sheet past the gate. Because slippage between the sheet and the soft rollers can occur, if a sheet is being moved by the conveyor belts in a non-perpendicular manner (i.e., the leading edge of the sheet makes an acute angle with the gate) to the gate, the hard rollers will engage, descend and contact the sheet.

In summary, the soft rollers exert a minimal amount of pressure on the sheets passing thereunder and are riders permitting slipping between the sheet and the soft rollers. This prevents bunching and permits registration/squaring of the sheets. On the other hand, the hard rollers exert pressure on the sheets to assist in the driving and movement of the sheets downstream.

The hard rollers are employed (engaged) only when the gate is down (nonengaged) and the soft rollers are only employed (engaged) when the gate is up (engaged).

The nip/pull rollers 100 are conventional rollers, such as those described in the patents cited above. They may be heated for laminating the materials. Irrespective of their temperature, materials entering the nip are pulled therethrough by the rollers.

The sequencing and controlling of the rollers and gate are done by conventional means, such as one or more visual sensor(s) or counters (schematically shown and labeled "SENSOR/COUNTER" in FIG. 4). The sensor(s)/counter(s) identify an event and send a signal to the hard rollers, soft rollers and gate. For example, when a leading edge of a sheet is detected or an overlap is sensed, a signal will cause the rollers and/or gate to engage or disengage. In this manner, sheets of different lengths can be easily employed and the system adapted to accommodate them. In the preferred embodiment, a counter and software are employed. The counter counts the longitudinal progress of the sheets and sends the signals to the rollers/gate.

Figure 6:
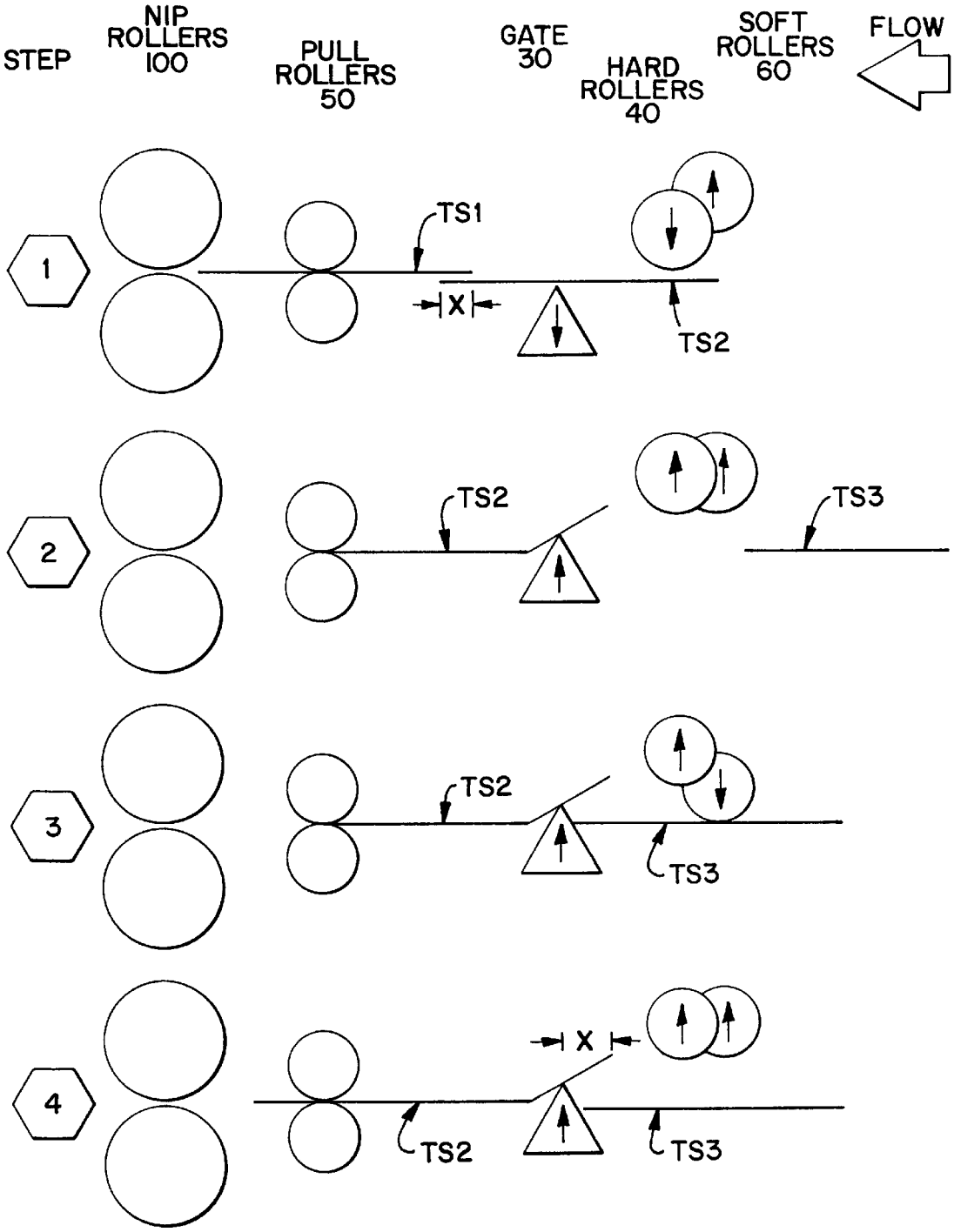
FIG. 6 is a sequencing diagram of the assembly.

The sensor(s)/counter(s), switches, rollers and gate are coordinated to the following sequence, also shown graphically (in exaggerated form) in FIG. 6:

First Sequence

The gate is down/retracted in the nonengaging position
The soft rollers are in the nonengaging position
The hard rollers are in the engaging position
The conveyor belts are moving in a direction downstream (F)
The nip/pull rollers are rotating

| | |
|---|---|
| Summary of Events | The top, first sheet (TS1) and the subsequent, second sheet (TS2) (under the first sheet) are at a predetermined overlap and travel to and/or through the pull/nip rollers 50; the conveyor belts, hard rollers 40 and nip/pull rollers 50 are moving the sheets (TS1 and TS2) downstream (F); and, this sequence continues until the subsequent, second sheet (TS2) reaches a point just after the nip/pull rollers 50. |

Second Sequence

The gate is up in the engaging/blocking position
The soft rollers are in the nonengaging position
The hard rollers are in the nonengaging position
The conveyor belts are moving in a direction downstream (F)
The nip/pull rollers are rotating

| | |
|---|---|
| Summary of Events | When the second, subsequent sheet (TS2) reaches a point just after the nip/pull rollers 50, the gate 30 moves up to the engaging position and the hard rollers disengage 40, the soft rollers 60 already being disengaged; the conveyor belts continue moving the second sheet (TS2) to/through the nip/pull rollers; the nip/pull rollers 50 continue to pull the second sheet (TS2) downstream (F); a third sheet (TS3) is released by the feeder (following the second sheet (TS2)); and, this sequence continues until the third sheet (TS3) reaches the soft rollers 60. |

Third Sequence

The gate is up in the engaging/blocking position
The soft rollers are in the engaging position
The hard rollers are in the disengaging position
The conveyor belts are moving in a direction downstream (F)
The nip/pull rollers are rotating

| | |
|---|---|
| Summary of Events | When the third sheet (TS3) reaches the soft rollers 60, the soft rollers 60 engage; the conveyor belts with the soft rollers 60 move the third sheet (TS3) to the gate 30 and the third sheet is squared/registered at the gate 30 as slippage is permitted by the engaged soft rollers 60; the conveyor belts continue moving the second sheet to/through the nip/pull rollers 50; the nip/pull rollers 50 continue to pull the second sheet (TS2) downstream (F); and, this sequence continues until the third sheet (TS3) is squared/registered with the gate. |

Fourth Sequence

The gate is up in the engaging position
The soft rollers are in the disengaging position
The hard rollers are in the disengaging position
The conveyor belts are moving in a direction downstream (F)
The nip/pull rollers are rotating

| | |
|---|---|
| Summary of Events | Once the third sheet (TS3) is squared/registered at the gate 30, the soft rollers 60 disengage; the third sheet (TS3) waits at the gate 30 (while the conveyor belts below the third sheet (TS3) continue to move); the conveyor belts continue moving the second sheet (TS2) to/through the nip/pull rollers 50; the nip/pull rollers 50 continue to pull the second sheet (TS2) downstream (F); and, this sequence continues until a previously determined/selected lap spacing (X) (overlap of the second sheet (TS2) (now on top) and the third sheet (TS3) (below the second sheet)) is obtained. |

Return to First Sequence

The gate is down/retracted in the nonengaging position
The soft rollers are in the nonengaging position The hard rollers are in the engaging position The conveyor belts are moving in a direction downstream (F)

The nip/pull rollers are rotating

| | |
|---|---|
| Summary of Events | When a previously selected lap spacing (X) (overlap of the second sheet (TS2) (now on top) and the third sheet (TS3) (under the second sheet)) is obtained and established, the hard rollers 40 engage and the gate 30 disengages (retracts); the second sheet (TS2) (now top sheet) and the subsequent, third sheet (TS3) (under the second sheet) are overlapped (X) and travel to the nip/pull rollers 50; the conveyor belts, hard rollers 40 and nip/pull rollers 50 are moving the two sheets (TS2 and TS3) together downstream (F); and, this sequence continues until the subsequent, third |

Return to Second and Subsequent Sequences

The Second Sequence above is repeated followed by the Third Sequence and Fourth Sequence. This four sequence cycle is then repeated over and over.

While the specific embodiments have been illustrated and described, numerous modifications are possible without significantly departing from the spirit of the invention and the scope of protection is only limited by the scope of the accompanying claims.

We claim:

1. A registration system for a sheet feeder comprising:

feeder means for longitudinally feeding a plurality of sheets sequentially from an upstream position to a downstream position;

a retractable gate movable between an engaging position and a disengaging position, in the disengaging position the gate not affecting the longitudinal movement of a sheet being fed by the feeder means and in the engaging position the gate contacting a leading edge of a sheet and stopping the longitudinal movement of the sheet being fed by the feeder means;

a first roller upstream of the gate moveable between an engaging position and a disengaging position, in the disengaging position the first roller not affecting the longitudinal movement of a sheet and in the engaging position the first roller contacting and placing pressure upon a sheet being fed by the feeder means while simultaneously permitting slippage between the sheet and the first roller;

a second roller upstream of the gate moveable between an engaging position and a disengaging position, in the disengaging position the second roller not affecting the longitudinal movement of a sheet and in the engaging position the second roller placing greater pressure upon the sheet than the first roller and frictionally engaging a sheet being fed by the feeder means; and, control means for engaging and disengaging the first and second rollers and the gate.

2. The registration system of claim 1 wherein the first rollers are at least two transversely spaced apart rollers and the second rollers are also at least two transversely spaced apart rollers.

3. The registration system of claim 2 further including pulling means located downstream of the gate and the first and second rollers for pulling the sheets being fed by the feeder means.

4. The registration system of claim 3 wherein the feeder means is a conveyer in communication with the first and second rollers when the roller is in the engaging position.

5. The registration system of claim 4 wherein the conveyor is a plurality of parallel, high friction conveyor belts, each roller communicating with at least one belt when the roller is in the engaging position.

6. The registration system of claim 5 wherein the pulling means is a pair of pressure nip rollers.

7. The registration system of claim 6 wherein the conveyor belts are entrained around two shafts, each shaft having couplers thereon disposed between the belts with low friction, smooth outer surfaces.

8. The registration system of claim 7 wherein the first and second rollers are each attached to a control member by a cantilevered arm.

9. The registration system of claim 8 wherein each control member is supported on a transverse support rod and adapted to be moveable relative to the support rod and selectively locked into a position on the support rod to selectively control the transverse distance between each control member.

10. A registration system for a sheet feeder comprising:

feeder means for continuously and longitudinally feeding a plurality of sheets sequentially from an upstream position to a downstream position;

a retractable gate movable between an engaging position and a nonengaging position, in the nonengaging position the gate not affecting the longitudinal movement of a sheet being fed by the feeder means and in the engaging position the gate contacting a leading edge of a sheet and stopping the longitudinal movement of the sheet being fed by the feeder means;

at least two transversely spaced apart first rollers upstream of the gate moveable between an engaging position and a nonengaging position, in the nonengaging position the first rollers not affecting the longitudinal movement of a sheet and in the engaging position the first rollers contacting and putting a first pressure upon a sheet being fed by the feeder means while simultaneously permitting slippage between the sheet and the first rollers;

at least two transversely spaced apart second rollers upstream of the gate moveable between an engaging position and a nonengaging position, in the nonengaging position the second rollers not affecting the longitudinal movement of a sheet and in the engaging position the second rollers contacting and putting a second pressure upon the sheet being fed by the feeder means, the second pressure being greater than the first pressure; and, control means for engaging, nonengaging and coordinating the first and second rollers and the gate such that the first rollers are put into the engaging position only when the gate is in the engaging position and the second rollers are put into the engaging position only when the gate is in the nonengaging position.

11. The registration system of claim 10 wherein the control means coordinates the first and second rollers and the gate to the following sequence:

a) the gate is in the nonengaging position, the first rollers are in the nonengaging position, and the second rollers are in the engaging position;

b) the gate is in the engaging position, the first rollers are in the nonengaging position, and the second rollers are in the nonengaging position;

c) the gate is in the engaging position, the first rollers are in the engaging position, and the second rollers are in the nonengaging position;

d) the gate is in the engaging position, the first rollers are in the nonengaging position, and the second rollers are in the nonengaging position.

12. The registration system of claim 10 further including continuous pulling means located downstream of the gate and the first and second rollers for pulling the sheets being fed by the feeder means and the feeder means is a conveyer in communication with the first and second rollers when the roller is in the engaging position.

13. The registration system of claim 12 wherein the conveyor is a plurality of parallel, high friction conveyor belts, each roller communicating with at least one belt when the roller is in the engaging position and the pulling means is a pair of pressure nip rollers.

14. A registration system for a sheet feeder comprising:

feeder means for continuously and longitudinally feeding a plurality of sheets sequentially from an upstream position to a downstream position;

a retractable gate movable between being engaged and disengaged, when disengaged the gate not affecting the longitudinal movement of a sheet being fed by the feeder means and when engaged the gate contacting a leading edge of a sheet and stopping the longitudinal movement of the sheet being fed by the feeder means;

at least two transversely spaced apart first rollers upstream of the gate moveable between being engaged and disengaged, when disengaged the first rollers not affecting the longitudinal movement of a sheet and when engaged the first rollers contacting a sheet being fed by the feeder means while simultaneously permitting slippage between the sheet and the first rollers;

at least two transversely spaced apart second rollers upstream of the gate moveable between being engaged and disengaged, when disengaged the second rollers not affecting the longitudinal movement of a sheet and when engaged the second rollers frictionally engaging a sheet being fed by the feeder means; and, control means for engaging, disengaging and coordinating the first and second rollers and the gate to the following repeatable cycle:

a) while the gate is disengaged, the first rollers are disengaged and the second rollers are engaged, the feeder means in combination with the second rollers moving a first sheet and a second sheet downstream;

b) while the gate is engaged, and the first and second rollers are disengaged, the feeder means moving the second sheet further downstream and a third sheet to the first rollers;

c) while the gate is engaged, the first rollers are engaged and the second rollers are disengaged, the feeder means moving the second sheet further downstream and in combination with the first rollers moving the third sheet until the third sheet is aligned with the gate; and, d) while the gate is engaged, and the first and second rollers are disengaged, the feeder means moving the second sheet downstream.

15. The registration system of claim 14 further including continuous pulling means located downstream of the gate and the first and second rollers for pulling the sheets being fed by the feeder means and the feeder means is a conveyer in communication with the first and second rollers when the roller is in the engaging position.

16. The registration system of claim 15 wherein the conveyor is a plurality of parallel, high friction conveyor belts, each roller communicating with at least one belt when the roller is engaged and the pulling means is a pair of pressure nip rollers.

17. The registration system of claim 16 wherein the conveyor belts are entrained around two shafts, each shaft having couplers thereon disposed between the belts with low friction, smooth outer surfaces and the first and second rollers are each attached to a control member by a cantilevered arm.

18. A method of registering a plurality of sequentially fed sheets comprising the steps of:

a) continuously running a conveyor system for supporting each sheet and moving the sheet from an upstream position to a downstream position;

b) positioning a retractable gate movable between being engaged and disengaged, when disengaged the gate not affecting the longitudinal movement of a sheet being fed by the feeder means and when engaged the gate contacting a leading edge of a sheet and stopping the longitudinal movement of the sheet being fed by the feeder means;

c) positioning at least two transversely spaced apart first rollers upstream of the gate moveable between being engaged and disengaged, when disengaged the first rollers not affecting the longitudinal movement of a sheet and when engaged the first rollers contacting a sheet being fed by the feeder means while simultaneously permitting slippage between the sheet and the first rollers;

d) positioning at least two transversely spaced apart second rollers upstream of the gate moveable between being engaged and disengaged, when disengaged the second rollers not affecting the longitudinal movement of a sheet and when engaged the second rollers frictionally engaging a sheet being fed by the feeder means; and, e) controlling and coordinating the first and second rollers and the gate to follow the cycle:

i) while the gate is disengaged, the first rollers are disengaged and the second rollers are engaged, the feeder means in combination with the second rollers moving a first sheet and a second sheet downstream;

ii) while the gate is engaged, and the first and second rollers are disengaged, the feeder means moving a second sheet further downstream and a third sheet to the first rollers;

iii) while the gate is engaged, the first rollers are engaged and the second rollers are disengaged, the feeder means moving the second sheet further downstream and in combination with the first rollers moving the third sheet until the third sheet is aligned with the gate; and, iv) while the gate is engaged, and the first and second rollers are disengaged, the feeder means moving the second sheet further downstream.

19. The method of claim 18 further including the steps of positioning continuous pulling means downstream of the gate and the first and second rollers to pulling the sheets being fed by the feeder means.

20. The method of claim 19 further including the steps of employing a conveyer as feeder means that is in communi cation with the first and second rollers when the roller is in the engaging position.

21. The method of claim 20 further including the steps of employing a plurality of parallel, high friction conveyor belts as the conveyor, each roller communicating with at least one belt when the roller is engaged and the pulling means is a pair of pressure nip rollers.

22. The method of claim 21 further including the steps of entraining the belts around two shafts, each shaft having couplers thereon disposed between the belts with low friction, smooth outer surfaces and the first and second rollers are each attached to a control member by a cantilevered arm.

* * * * *

UNITED STATES PATENT AND TRADEMARK OFFICE

CERTIFICATE OF CORRECTION

PATENT NO. : 5,772,202
DATED : June 30, 1998
INVENTOR(S) : Karl Singer, Lawrence B. LeStarge and Robert Allen Crimmins It is certified that error appears in the above-identified patent and that said Letters Patent is hereby corrected as shown below: On the title page, Item [56]

Foreign Patent Documents section: Japanese Patent Application No. 59-57843 should be cited.

Col. 9, line 19, in the "Summary of Events" after "third" insert --sheet (TS3) reaches a point just after the nip/pull rollers 50.--

Col. 9, line 42, after "a first roller" insert --mounted on a first support means--

Col. 9, line 50, after "a second roller" insert --mounted on a second support means--

Col. 10, line 34, after "first rollers" insert --mounted on a first support means--

Col. 10, line 43, after "second rollers" insert --mounted on a second support means--

Col. 11, line 28, after "first rollers" insert --mounted on a first support means--

Col. 11, line 35, after "second rollers" insert --mounted on a second support means--

Col. 12, line 26, after "rollers" insert --mounted on a first support means--

Col. 12, line 35, after "second rollers" insert --mounted on a second support means--

Signed and Sealed this

Twenty-third Day of March, 1999

*Attest:*

Q. TODD DICKINSON

*Attesting Officer*

*Acting Commissioner of Patents and Trademarks*